US011638859B2

(12) United States Patent
Milleman et al.

(10) Patent No.: US 11,638,859 B2
(45) **Date of Patent: *May 2, 2023**

(54) MIXED MATERIAL GOLF CLUB HEAD

(71) Applicant: KARSTEN MANUFACTURING CORPORATION, Phoenix, AZ (US)

(72) Inventors: Travis D. Milleman, Portland, OR (US); Ryan M. Stokke, Anthem, AZ (US); Eric J. Morales, Laveen, AZ (US); Martin R. Jertson, Phoenix, AZ (US); Tyler A. Shaw, Paradise Valley, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/249,681

(22) Filed: Mar. 9, 2021

(65) Prior Publication Data

US 2021/0187370 A1 Jun. 24, 2021

Related U.S. Application Data

(63) Continuation of application No. 16/714,109, filed on Dec. 13, 2019, now Pat. No. 10,940,373, which is a (Continued)

(51) Int. Cl.

| | |
|---|---|
| ***A63B 53/04*** | (2015.01) |
| ***A63B 60/02*** | (2015.01) |
| ***A63B 60/00*** | (2015.01) |

(52) U.S. Cl.

CPC ..... *A63B 53/0475* (2013.01); *A63B 53/0466* (2013.01); *A63B 60/02* (2015.10); (Continued)

(58) Field of Classification Search

CPC . A63B 53/0475; A63B 60/02; A63B 53/0466; A63B 2209/02; A63B 2209/00; (Continued)

(56) References Cited

U.S. PATENT DOCUMENTS

| | | | | |
|---|---|---|---|---|
| 4,581,190 | A | 4/1986 | Nagamoto et al. | |
| 4,602,787 | A * | 7/1986 | Sugioka ..... | A63B 53/0466 473/346 |

(Continued)

FOREIGN PATENT DOCUMENTS

| | | |
|---|---|---|
| JP | 2004024734 | 1/2004 |
| JP | 2006271770 | 10/2006 |

(Continued)

OTHER PUBLICATIONS

E9 Face Technology With Dual Roll-Multi-material Construction, Cobra Golf, accessed Oct. 19, 2017; https:/lwww.cobragolf.com/pumagolf/tech—overview.

(Continued)

*Primary Examiner* — Sebastiano Passaniti

(57) ABSTRACT

A hollow golf club head includes a metallic front body coupled with a composite rear body. The front body includes a strike face and a surrounding frame that extends rearward from a perimeter of the strikeface. The rear body includes a crown member coupled with a sole member. The sole member can have a structural layer formed from a filled thermoplastic material. The crown member can have structural layer and/or a resilient layer. The structural and resilient layers can be formed from fiber-reinforced thermoplastic composite material. The sole member has an opening through which a metallic weight pad at least partially extends. The weight pad is bonded to the structural layer and includes an aperture for attaching a metallic weight.

38 Claims, 10 Drawing Sheets

Related U.S. Application Data continuation-in-part of application No. 16/380,873, filed on Apr. 10, 2019, now Pat. No. 10,765,922, which is a continuation of application No. 15/901,081, filed on Feb. 21, 2018, now Pat. No. 10,300,354, which is a continuation of application No. 15/607,166, filed on May 26, 2017, now Pat. No. 9,925,432.

(60) Provisional application No. 62/342,741, filed on May 27, 2016, provisional application No. 62/779,335, filed on Dec. 13, 2018.

(52) U.S. Cl.
CPC ..... *A63B 53/04* (2013.01); *A63B 53/042* (2020.08); *A63B 53/045* (2020.08); *A63B 53/047* (2013.01); *A63B 53/0416* (2020.08); *A63B 53/0433* (2020.08); *A63B 53/0437* (2020.08); *A63B 60/002* (2020.08); *A63B 2053/0491* (2013.01); *A63B 2209/00* (2013.01); *A63B 2209/02* (2013.01)

(58) Field of Classification Search
CPC ..... A63B 53/047; A63B 53/04; A63B 2053/0491; A63B 53/042; A63B 53/045; A63B 53/0416; A63B 53/0433; A63B 53/0437; A63B 60/002
USPC ..... 473/324–350, 287–292
See application file for complete search history.

(56) References Cited

U.S. PATENT DOCUMENTS 4,664,383 A 5/1987 Aizawa
5,080,366 A 1/1992 Okumoto et al.
5,193,811 A 3/1993 Okumoto et al.
5,328,176 A 7/1994 Lo
5,586,949 A 12/1996 Aizawa
5,614,143 A 3/1997 Hager
5,624,331 A 4/1997 Lo et al.
5,669,827 A 9/1997 Nagamoto
6,354,962 B1 3/2002 Galloway et al.
6,354,963 B1 3/2002 Kodama et al.
6,368,234 B1 4/2002 Galloway
6,381,828 B1 5/2002 Boyce et al.
6,390,933 B1 5/2002 Galloway et al.
6,435,977 B1 8/2002 Helmstetter et al.
6,440,011 B1 8/2002 Hocknell et al.
6,471,604 B2 10/2002 Hocknell et al.
6,491,592 B2 12/2002 Cackett et al.
6,524,197 B2 * 2/2003 Boone ..... A63B 53/0466 473/324
6,565,452 B2 5/2003 Helmstetter et al.
6,575,845 B2 6/2003 Galloway et al.
6,582,323 B2 6/2003 Soracco et al.
6,602,149 B1 8/2003 Jacobson et al.
6,605,007 B1 8/2003 Bissonnette et al.
6,648,774 B1 11/2003 Lee
6,663,504 B2 12/2003 Hocknell et al.
6,739,982 B2 5/2004 Murphy et al.
6,739,983 B2 5/2004 Helmstetter et al.
6,743,118 B1 6/2004 Soracco
6,758,763 B2 7/2004 Murphy et al.
6,860,823 B2 3/2005 Lee
6,926,619 B2 8/2005 Helmstetter et al.
6,929,565 B2 8/2005 Nakahara et al.
6,994,637 B2 2/2006 Murphy et al.
7,025,692 B2 4/2006 Erickson et al.
7,029,403 B2 4/2006 Rice et al.
7,059,973 B2 6/2006 Erickson et al.
7,066,835 B2 6/2006 Evans
7,101,289 B2 9/2006 Gibbs et al.
7,108,614 B2 9/2006 Lo
7,115,047 B2 10/2006 Stevens et al.
7,118,493 B2 10/2006 Galloway
7,121,955 B2 10/2006 Stevens et al.
7,121,957 B2 10/2006 Hocknell et al.
7,125,344 B2 10/2006 Hocknell et al.
7,128,661 B2 10/2006 Soracco et al.
7,137,907 B2 11/2006 Gibbs
7,144,333 B2 12/2006 Murphy et al.
7,147,576 B2 12/2006 Imamoto et al.
7,163,470 B2 1/2007 Galloway et al.
7,166,038 B2 1/2007 Williams et al.
7,169,060 B2 1/2007 Stevens et al.
7,175,541 B2 2/2007 Lo
7,214,142 B2 5/2007 Meyer et al.
7,252,600 B2 8/2007 Murphy et al.
7,255,654 B2 8/2007 Murphy et al.
7,258,624 B2 8/2007 Kobayashi
7,258,625 B2 8/2007 Kawaguchi et al.
7,261,645 B2 8/2007 Oyama
7,278,927 B2 10/2007 Gibbs et al.
7,297,072 B2 11/2007 Meyer et al.
7,303,487 B2 12/2007 Kumamoto
7,311,613 B2 12/2007 Stevens et al.
7,318,782 B2 1/2008 Imamoto et al.
7,320,646 B2 1/2008 Galloway
7,338,390 B2 3/2008 Lindsay
7,344,452 B2 3/2008 Imamoto et al.
7,367,900 B2 5/2008 Kumamoto
7,377,860 B2 5/2008 Breier et al.
7,387,577 B2 6/2008 Murphy et al.
7,402,112 B2 7/2008 Galloway
7,407,448 B2 8/2008 Stevens et al.
7,438,647 B1 10/2008 Hocknell
7,438,649 B2 10/2008 Ezaki et al.
7,448,964 B2 11/2008 Schweigert et al.
7,455,600 B2 11/2008 Imamoto et al.
7,468,005 B2 12/2008 Kouno
7,488,261 B2 2/2009 Cackett et al.
7,491,134 B2 2/2009 Murphy et al.
7,494,424 B2 2/2009 Williams et al.
7,497,788 B2 3/2009 Imamoto et al.
7,497,789 B2 3/2009 Burnett et al.
7,510,485 B2 3/2009 Yamamoto
7,520,822 B2 4/2009 Yamagishi et al.
7,524,249 B2 4/2009 Breier et al.
7,530,901 B2 5/2009 Imamoto et al.
7,530,903 B2 5/2009 Imamoto et al.
7,540,812 B2 6/2009 Imamoto et al.
7,549,935 B2 6/2009 Foster et al.
7,559,851 B2 7/2009 Cackett et al.
7,568,982 B2 8/2009 Cackett et al.
7,582,248 B2 9/2009 Reyes et al.
7,591,737 B2 9/2009 Gibbs et al.
7,601,078 B2 10/2009 Mergy et al.
7,607,992 B2 10/2009 Nishio
7,632,193 B2 12/2009 Thielen
7,658,686 B2 2/2010 Soracco
7,674,187 B2 3/2010 Cackett et al.
7,691,008 B2 4/2010 Oyama
7,708,652 B2 5/2010 Cackett et al.
7,749,096 B2 7/2010 Gibbs et al.
7,749,103 B2 7/2010 Nakano
7,775,903 B2 8/2010 Kawaguchi et al.
7,785,212 B2 8/2010 Lukasiewicz et al.
7,803,065 B2 9/2010 Breier et al.
7,854,364 B2 12/2010 DeShiell et al.
7,922,604 B2 4/2011 Roach et al.
7,931,546 B2 4/2011 Bennett et al.
7,938,740 B2 5/2011 Breier et al.
7,959,523 B2 6/2011 Rae et al.
7,967,591 B2 6/2011 Reyes et al.
7,993,216 B2 8/2011 Lee
8,007,371 B2 8/2011 Breier et al.
8,025,591 B2 9/2011 Cruz et al.
8,197,357 B1 6/2012 Rice et al.
8,197,358 B1 6/2012 Watson et al.
8,221,261 B2 7/2012 Curtis et al.
8,267,808 B2 9/2012 De La Cruz et al.
8,303,433 B2 11/2012 Roach et al.
8,308,582 B2 11/2012 Tanimoto

(56) References Cited

U.S. PATENT DOCUMENTS

| | | | | |
|---|---|---|---|---|
| 8,376,876 | B2 | 2/2013 | Gibbs et al. | |
| 8,414,422 | B2 | 4/2013 | Peralta et al. | |
| 8,419,569 | B2 | 4/2013 | Bennett et al. | |
| 8,425,827 | B2 | 4/2013 | Lee | |
| 8,435,137 | B2 | 5/2013 | Hirano | |
| 8,444,506 | B2 | 5/2013 | Watson et al. | |
| 8,460,123 | B1 | 6/2013 | DeMille et al. | |
| 8,491,416 | B1 | 7/2013 | DeMille et al. | |
| 8,506,421 | B2 | 8/2013 | Stites et al. | |
| 8,517,859 | B2 | 8/2013 | Golden et al. | |
| 8,523,705 | B2 | 9/2013 | Breier et al. | |
| 8,540,588 | B2 | 9/2013 | Rice et al. | |
| 8,556,746 | B1 | 10/2013 | DeMille et al. | |
| 8,608,591 | B2 | 12/2013 | Chao | |
| 8,632,419 | B2 | 1/2014 | Tang et al. | |
| 8,632,420 | B2 | 1/2014 | Kawaguchi et al. | |
| 8,696,489 | B2 | 4/2014 | Gibbs et al. | |
| 8,702,534 | B2 | 4/2014 | DeMille et al. | |
| 8,715,109 | B2 | 5/2014 | Bennett et al. | |
| 8,727,911 | B2 | 5/2014 | DeMille et al. | |
| 8,753,226 | B2 | 6/2014 | Rice et al. | |
| 8,758,164 | B2 * | 6/2014 | Breier | A63B 60/54 473/332 |
| 8,790,196 | B2 | 7/2014 | Solheim et al. | |
| 8,814,723 | B2 | 8/2014 | Tavares et al. | |
| 8,858,362 | B1 | 10/2014 | Leposky et al. | |
| 8,870,680 | B2 | 10/2014 | Yamamoto | |
| 8,870,683 | B2 | 10/2014 | Hettinger et al. | |
| 8,876,629 | B2 | 11/2014 | Deshmukh et al. | |
| 8,926,450 | B2 | 1/2015 | Takahashi et al. | |
| 8,938,871 | B2 | 1/2015 | Roach et al. | |
| 8,956,244 | B1 * | 2/2015 | Westrum | A63B 53/04 473/345 |
| 8,979,671 | B1 | 3/2015 | DeMille et al. | |
| 9,174,098 | B2 | 3/2015 | Hayase | |
| 9,033,818 | B2 | 5/2015 | Myrhum et al. | |
| 9,033,822 | B1 | 5/2015 | DeMille et al. | |
| 9,079,368 | B2 | 7/2015 | Tavares et al. | |
| 9,168,435 | B1 | 10/2015 | Boggs et al. | |
| 9,192,826 | B2 | 11/2015 | Golden et al. | |
| 9,199,137 | B2 | 12/2015 | Deshmukh et al. | |
| 9,259,627 | B1 * | 2/2016 | Myers | A63B 53/04 |
| 9,320,949 | B2 | 4/2016 | Golden et al. | |
| 9,352,198 | B2 | 5/2016 | Roach et al. | |
| 9,393,465 | B2 | 7/2016 | Stokke et al. | |
| 9,399,157 | B2 | 7/2016 | Greensmith | |
| 9,427,631 | B1 | 8/2016 | Larson et al. | |
| 9,433,834 | B2 | 9/2016 | Stites et al. | |
| 9,457,245 | B2 | 10/2016 | Lee | |
| 9,504,883 | B2 | 11/2016 | DeMille et al. | |
| 9,526,955 | B2 | 12/2016 | DeMille et al. | |
| 9,579,548 | B2 | 2/2017 | Boyd et al. | |
| 9,682,291 | B2 | 6/2017 | Chao | |
| 9,682,299 | B2 | 6/2017 | Tang et al. | |
| 9,687,702 | B1 * | 6/2017 | Seluga | A63B 53/0466 |
| 9,717,960 | B2 | 8/2017 | Deshmukh et al. | |
| 9,724,573 | B2 | 8/2017 | Kawaguchi et al. | |
| 9,833,666 | B2 | 12/2017 | Boggs et al. | |
| 9,861,866 | B2 | 1/2018 | DeMille et al. | |
| 9,908,014 | B1 | 3/2018 | Wester | |
| 9,925,432 | B2 | 3/2018 | Morales et al. | |
| 10,046,212 | B2 | 8/2018 | Sargent et al. | |
| 10,080,933 | B2 | 9/2018 | Stokke | |
| 10,143,898 | B2 | 12/2018 | Cornelius et al. | |
| 10,300,354 | B2 | 5/2019 | Morales et al. | |
| 10,357,901 | B2 | 7/2019 | Deshmukh et al. | |
| 10,675,514 | B2 | 6/2020 | Spackman et al. | |
| 10,765,922 | B2 * | 9/2020 | Morales | A63B 53/0466 |
| 10,806,977 | B2 | 10/2020 | Spackman et al. | |
| 10,940,373 | B2 * | 3/2021 | Milleman | A63B 60/02 |
| 10,940,374 | B2 * | 3/2021 | Milleman | A63B 60/006 |
| 2003/0032500 | A1 | 2/2003 | Nakahara | |
| 2003/0186760 | A1 | 10/2003 | Lee | |
| 2004/0033844 | A1 | 2/2004 | Chen | |
| 2004/0116207 | A1 | 6/2004 | Shiell et al. | |
| 2005/0026719 | A1 | 2/2005 | Yang | |
| 2005/0043115 | A1 | 2/2005 | Lin | |
| 2005/0143189 | A1 | 6/2005 | Lai et al. | |
| 2005/0159239 | A1 | 7/2005 | Imamoto et al. | |
| 2005/0233831 | A1 | 10/2005 | Ezaki et al. | |
| 2006/0052181 | A1 | 3/2006 | Serrano et al. | |
| 2007/0155533 | A1 | 7/2007 | Solheim et al. | |
| 2008/0293512 | A1 | 11/2008 | Chen | |
| 2009/0029796 | A1 | 1/2009 | Mergy et al. | |
| 2016/0332040 | A1 | 11/2016 | Lafortune et al. | |
| 2017/0128794 | A1 * | 5/2017 | Stokke | A63B 53/02 |
| 2017/0340932 | A1 * | 11/2017 | Morales | A63B 53/0475 |

FOREIGN PATENT DOCUMENTS

| | | |
|---|---|---|
| JP | 2013009713 | 1/2013 |
| WO | 2007076304 | 7/2007 |
| WO | 2017205699 | 5/2016 |

OTHER PUBLICATIONS

Taylormade M1 Driver, Multi-material Construction, accessed Jun. 7, 2016; http://www.intheholegolf.com/TM15-M1D/TaylorMade-M1-Driver.html.

Adams Men's Golf Speedline Super XTD Fairway Wood; Amazon, accessed Oct. 19, 2017; https://www.amazon.com/Adams-Golf-Speedline-SUPER-Fairway/dp/B007LI2S04.

Callaway Womens Great Big Bertha Driver, Amazon, accessed Oct. 19, 2017; https://www.amazon.com/Callaway-Womens-Great-Bertha-Driver/dp/B013SYR0VQ.

Nike Vapor Flex 440 Driver Adjustable Loft Golf Club Left Hand, accessed Jun. 7, 2016; http://www.globalgolf.com/golf-clubs/1034365-nike-vapor-flex-440-driver-left-hand/.

International Search Report and Written Opinion of the International Searching Authority from PCT Application No. PCT/US2019/014321, dated May 9, 2019.

International Search Report and Written Opinion of the International Searching Authority from PCT Application No. PCT/US2019/014326, dated May 23, 2019.

International Search Report and Written Opinion of the International Searching Authority from PCT Application No. PCT/US2017/034807, dated Aug. 2, 2017.

International Search Report and Written Opinion of the International Searching Authority from PCT Application No. PCT/US2019/066324, dated Feb. 19, 2020.

* cited by examiner

MIXED MATERIAL GOLF CLUB HEAD

CROSS-REFERENCE TO RELATED APPLICATIONS

This is a continuation of U.S. patent application Ser. No. 16/714,109, filed on Dec. 13, 2019, which claims the benefit of U.S. Provisional Appl. No. 62/779,335, filed on Dec. 13, 2018, and which is a continuation in part of U.S. patent application Ser. No. 16/380,873, filed on Apr. 10, 2019 and is now U.S. Pat. No. 10,765,922, which is a continuation of U.S. patent application Ser. No. 15/901,081, filed on Feb. 21, 2018 and is now U.S. Pat. No. 10,300,354, which is a continuation of U.S. patent application Ser. No. 15/607,166, filed on May 26, 2017 and is now U.S. Pat. No. 9,925,432, which claims the benefit of U.S. Provisional Appl. No. 62/342,741, filed on May 27, 2016, the contents of all of which are incorporated fully herein by reference.

TECHNICAL FIELD

This disclosure relates generally to a golf club head with a mixed material construction.

BACKGROUND

In general, there are many important physical parameters (i.e., volume, mass, etc.) that effect the overall performance of a golf club head. One of the most important physical parameters, is the total mass of the golf club head. The total mass of the golf club head is the sum of the total structural mass and the total discretionary mass. Structural mass generally refers to the mass of the materials that are required to provide the club head with the structural resilience needed to withstand repeated impacts. Structural mass is highly design-dependent and provides a designer with a relatively low amount of control over specific mass distribution. Conversely, discretionary mass is any additional mass (beyond the minimum structural requirements of the golf club head) that may be added to the club head design for the sole purpose of customizing the performance and/or forgiveness of the club. There is a need in the art for alternative designs to all metal golf club heads to provide a means for maximizing discretionary weight to maximize club head moment of inertia (MOI) and lower/back center of gravity (CG).

BRIEF DESCRIPTION OF THE DRAWINGS

This disclosure relates generally to sport equipment and relates more particularly to golf club heads and related methods.

Figure 2:
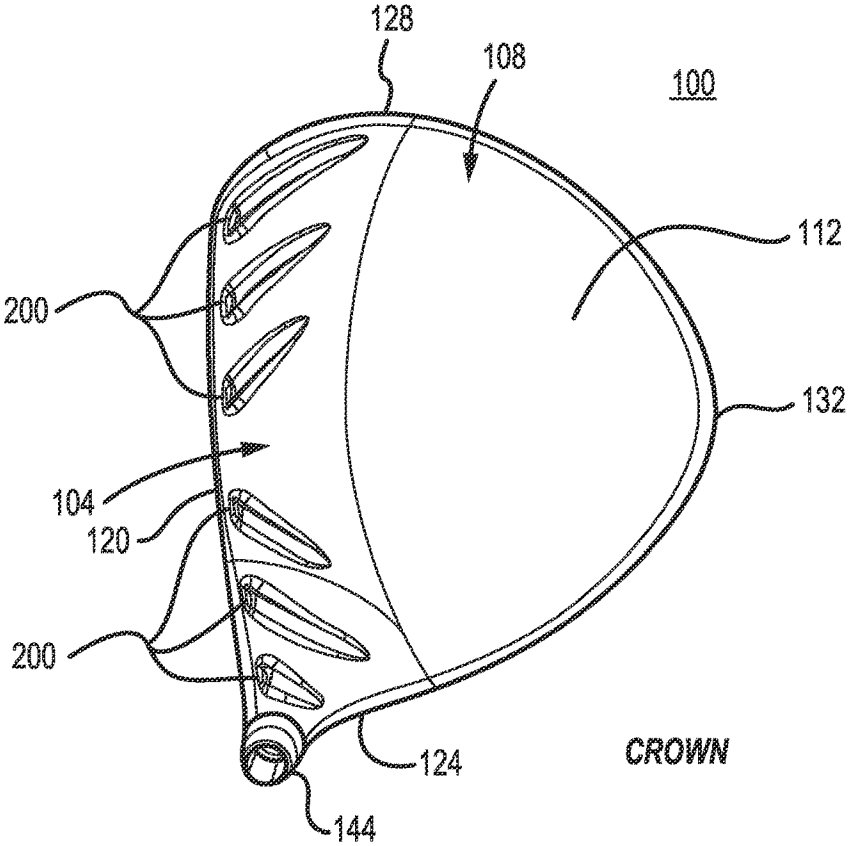
FIG. 2 illustrates a top view of the golf club head of FIG. 1.

Other aspects of the disclosure will become apparent by consideration of the detailed description and accompanying drawings.

DESCRIPTION

Described herein is a golf club head that comprises a mixed material rear body in combination with a metallic front body, comprising a strike face and surrounding frame. The mixed material rear body is comprised of a fiber reinforced thermoplastic composite resilient layer, a molded thermoplastic structural layer, a metallic weight pad, and a metallic weight secured within the metallic weight pad. The mixed material rear body construction provides a significant reduction in structural mass, allowing for improved allocation of discretionary mass, thus improvements in the MOI and CG of the golf club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "rear," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Described herein are various embodiments of a golf head having a mixed material construction. The mixed material construction comprises a metallic front body and a mixed material rear body. One embodiment of the club head includes a composite rear body with a metallic weight pad.

In these or other embodiments, the rear body of the club head can include a fiber reinforced thermoplastic composite resilient layer, a molded thermoplastic structural layer, and a metallic weight secured within the metallic weight pad. In another embodiment, the rear body of the club head can include a composite crown and sole, with a metallic weight secured within the metallic weight pad. In many embodiments, the golf club head can be wood-type golf club head (i.e. driver, fairway wood, hybrid).

In some embodiments, the club head can comprise a driver. In these embodiments, the loft angle of the club head can be less than approximately 16 degrees, less than approximately 15 degrees, less than approximately 14 degrees, less than approximately 13 degrees, less than approximately 12 degrees, less than approximately 11 degrees, or less than approximately 10 degrees. Further, in these embodiments, the volume of the club head can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In some embodiments, the club head can comprise a fairway wood. In these embodiments, the loft angle of the club head can be less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head can be between 12 degrees and 35 degrees, between 15 degrees and 35 degrees, between 20 degrees and 35 degrees, or between 12 degrees and 30 degrees.

In embodiments where the club head comprises a fairway wood, the volume of the club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In these embodiments, the volume of the club head can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250 cc-350 cc, or approximately 275 cc-375 cc.

In some embodiments, the club head can comprise a hybrid. In these embodiments, the loft angle of the club head can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In embodiments where the club head comprises a hybrid, the volume of the club head is less than approximately 200 cc, less than approximately 175 cc, less than approximately 150 cc, less than approximately 125 cc, less than approximately 100 cc, or less than approximately 75 cc. In some embodiments, the volume of the club head can be approximately 100 cc-150 cc, approximately 75 cc-150 cc, approximately 100 cc-125 cc, or approximately 75 cc-125 cc.

FIG. 1-10 illustrate an embodiment of a golf club head 100 having a metallic front body 104, and a rear body 108. The front body 104 and rear body 108 are secured together to define a substantially closed/hollow interior volume. As is conventional with wood-style golf heads, the golf club head 100 includes a crown 112, a sole 116, and can be divided into a heel region 124 and a toe region 128.

In some embodiments, the golf club head 100 comprises a metallic front body 104, and a composite rear body 108, wherein the rear body comprises a woven fiber reinforced thermoplastic resilient layer 148, a molded thermoplastic structural layer 152, and a metallic weight pad 156. The combination of a woven fiber reinforced thermoplastic resilient layer 148 and a molded thermoplastic structural layer 152, enables savings in structural mass, in comparison to a similar club head made entirely from metal.

The structural weight savings achieved by using a resilient layer 148 and a structural layer 152, can be used to either reduce the entire weight of the club head 100 (which may provide faster club head speed and/or long hitting distances) or to increase the amount of discretionary mass that is available for placement on the golf club head 100. In one embodiment, the additional discretionary mass, gained from using a composite resilient layer 148 and a composite structural layer 152, can be reintroduced into the club head 100 in the form of a metallic weight pad 156. The combination of a light composite rear body 108 and metallic weight pad 156, allow the club head 100, to allocate a mass majority of the club head in a position to maximize the MOI and CG, leading to more forgiveness and longer shots.

I. Front Body

Referring to FIGS. 4-7, the front body 104 of the club head 100 comprises a strike face 120, intended to impact a golf ball. The front body 104 comprises a surrounding frame 136 that extends rearward from a perimeter 140 of the strike face 120, to provide the front body 104 with a cup-shaped appearance. The surrounding frame 136 comprises an internal surface 170 and an external surface 172. Furthermore, the surrounding frame 136 can comprise a flange 174, to provide an attachment surface to connect the front body 104 and the rear body 108. When the front body 104 is combined with the rear body 108, the external surface 172 of the front body 104 forms a portion of the crown 112 and the sole 116 of the club head 100. The front body 104 further comprises a hosel 144 for receiving a golf club shaft or shaft adapter in the heel region 124 of the golf club head 100.

In some embodiments, the strike face 120 and surrounding frame 136 can be integrally formed. In other embodiments, the strike face 120 and surrounding frame 136 can be separately formed and joined together. In one embodiment, the strike face 120 is forged and the surrounding frame 136 is cast, then the strike face 120 and surrounding frame 136 are joined through welding, brazing, plasma welding, low-power laser welding, forging, or another suitable joining technique.

In many embodiments, the front body 104 is made from a metallic material to withstand the repeated impact stress from striking a golf ball. In some embodiments, the front body 104, can be formed from stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, the strike face 120 of the golf club head 100 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, an amorphous metal alloy, or a composite material.

The front body 104 comprises a mass. In some embodiments, wherein the strike face 120 and surrounding frame 136 are separate, the mass of the front body 104 is the sum of the mass of the strike face 120 and the mass of the surrounding frame 136. Depending on the material the front body 104 is made of, the mass of the front body 104 can range between 40 grams and 140 grams. In most embodiments, the mass of the front body 104 does not exceed 140 grams. In some embodiments, the mass of the front body 104 can range between 40-50 grams, 50-60 grams, 60-70 grams, 70-80 grams, 80-90 grams, 90-100 grams, 100-110 grams, 110-120 grams, 120-130 grams, or 130 grams-140 grams.

a. Strike Face

Figure 5:
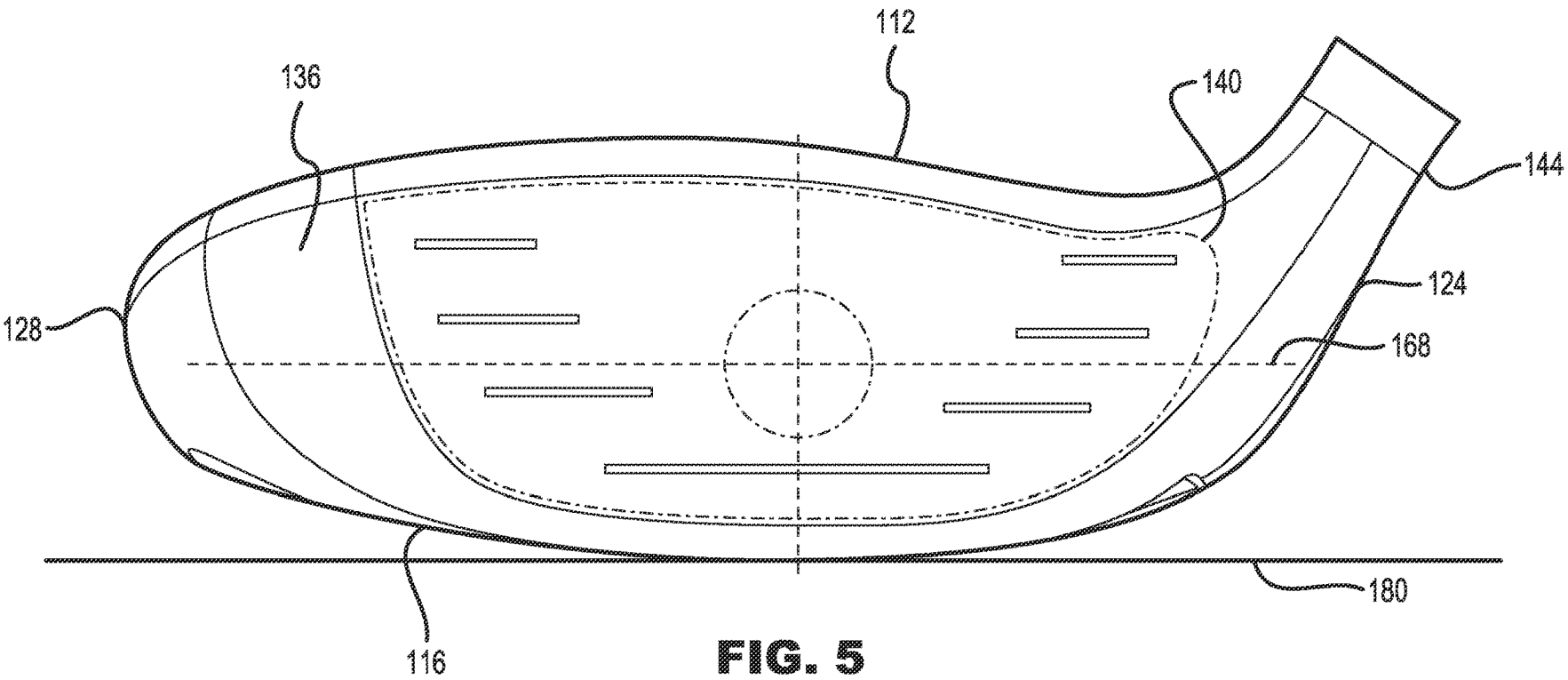
FIG. 5 illustrates a front planar view of the golf club head of FIG. 1.
Figure 6:
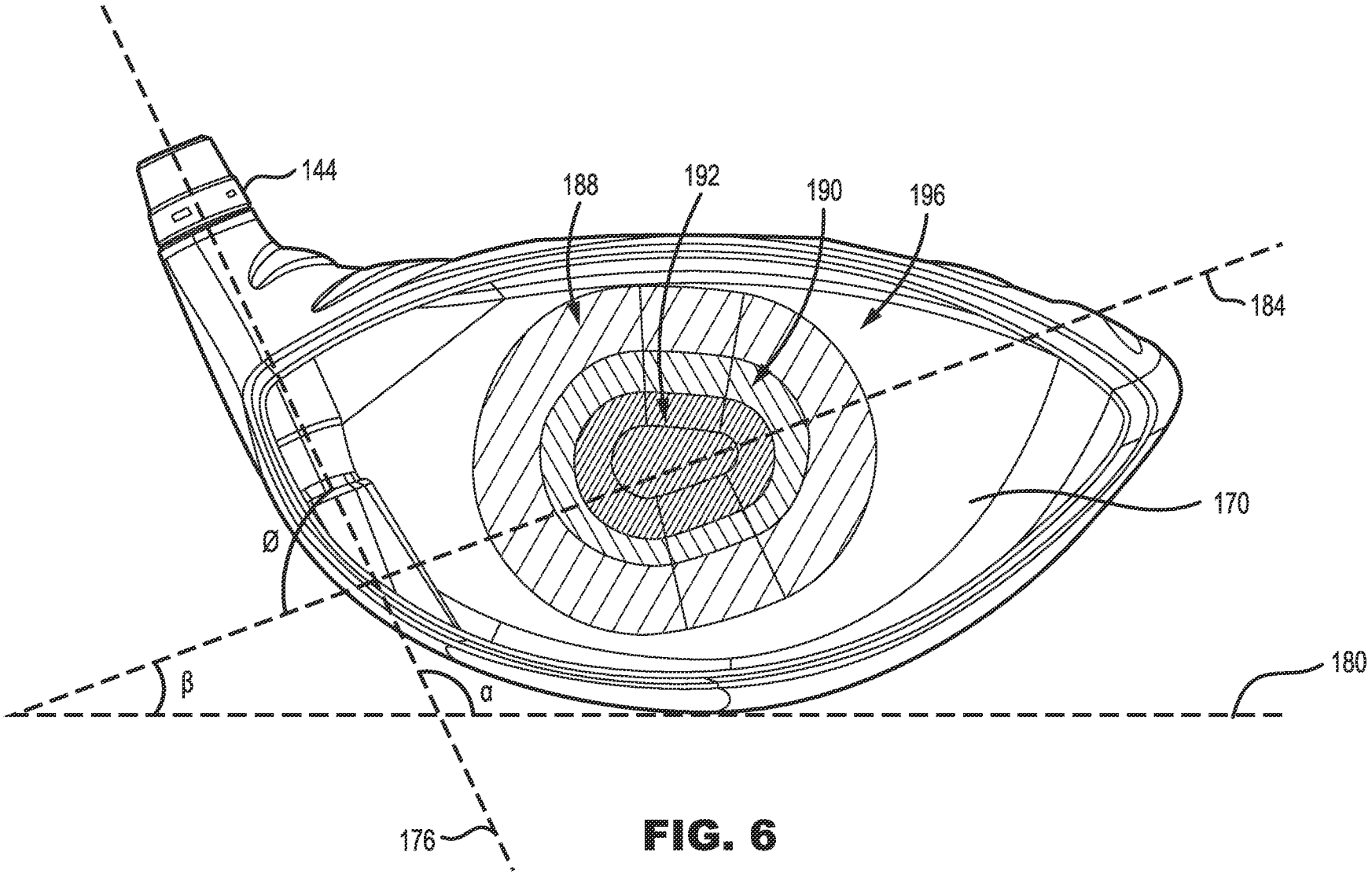
FIG. 6 illustrates rear planar view of a front body of the golf club head of FIG. 1.
Figure 8:
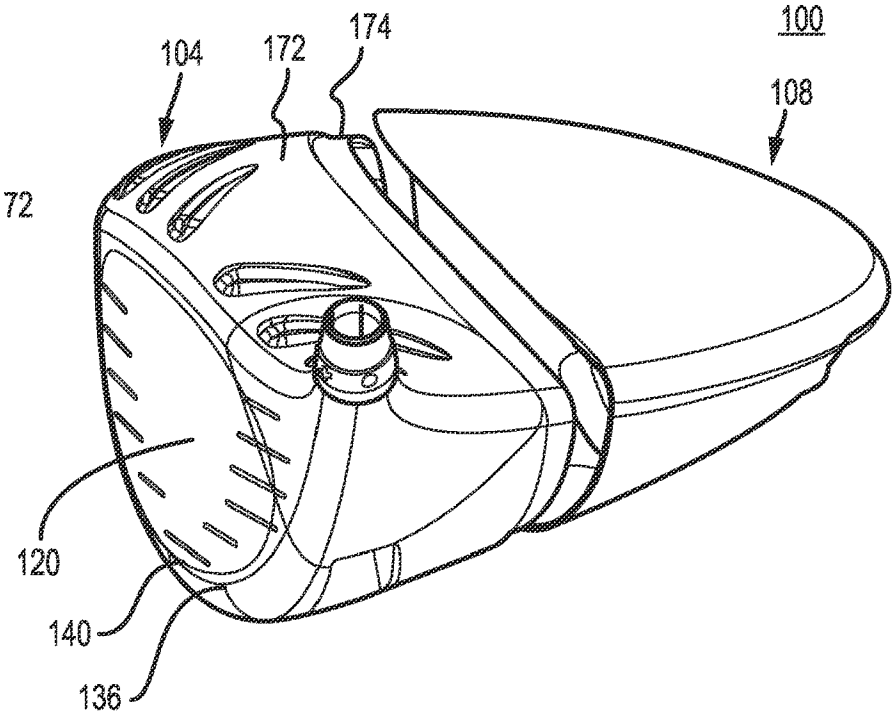
FIG. 8 illustrates an exploded view of the front body and a rear body of the golf club head of FIG. 1.
Figure 7:
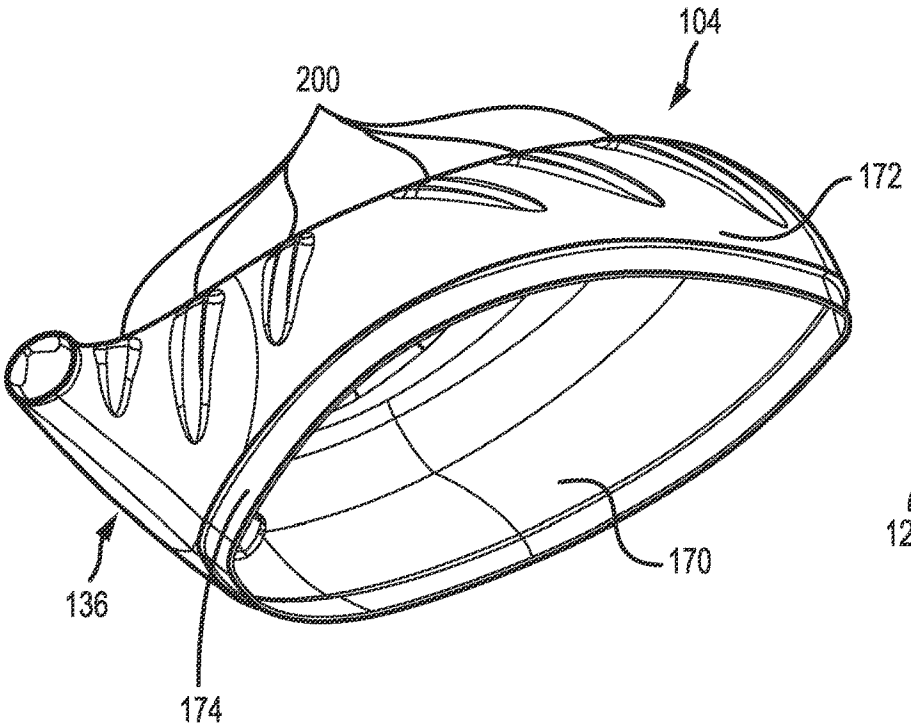
FIG. 7 illustrates a rear view of the front body of the golf club head of FIG. 1.
Figure 9:
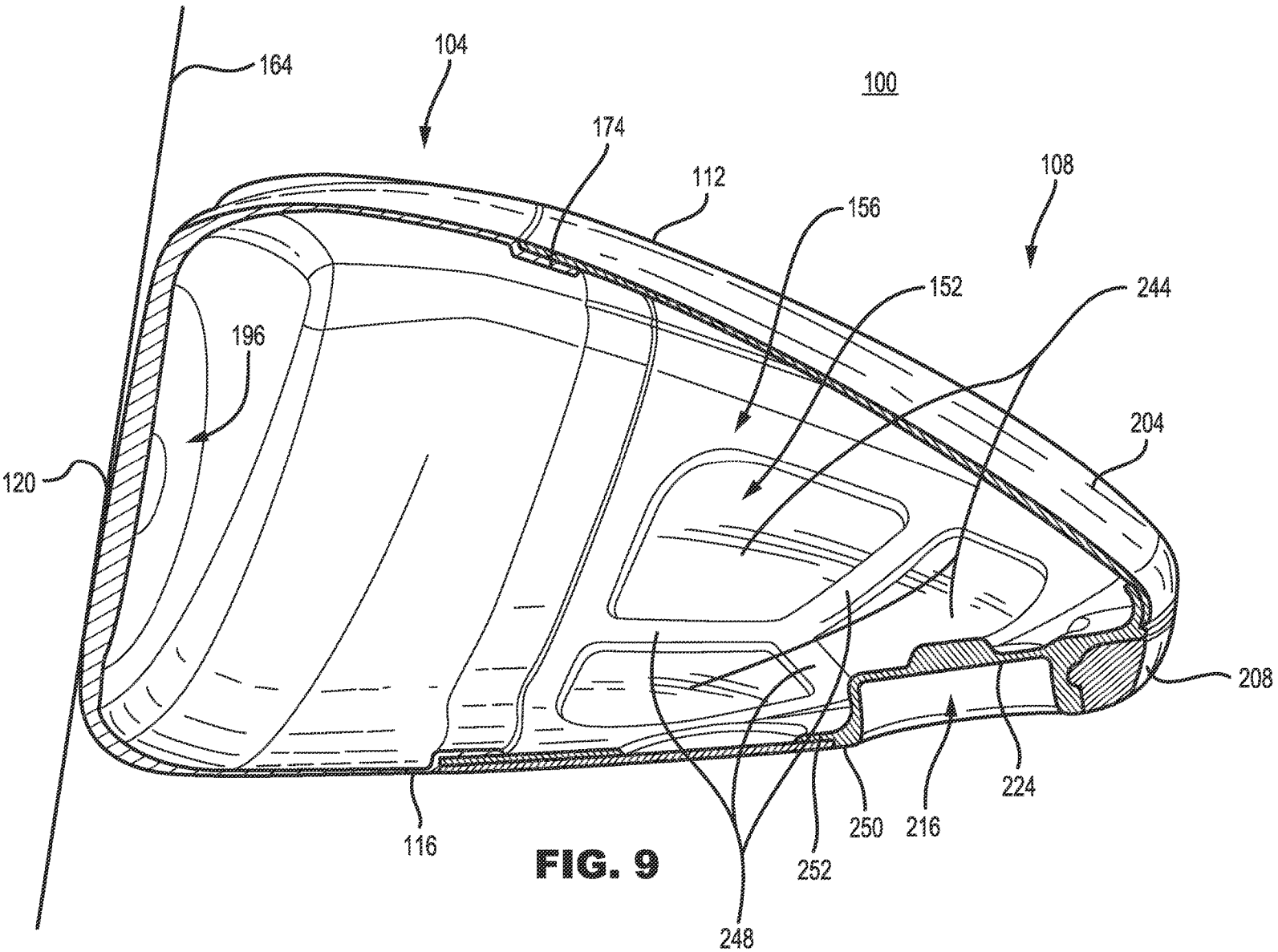
FIG. 9 illustrates a cross sectional view of the golf club head of FIG. 1.
Figure 11:
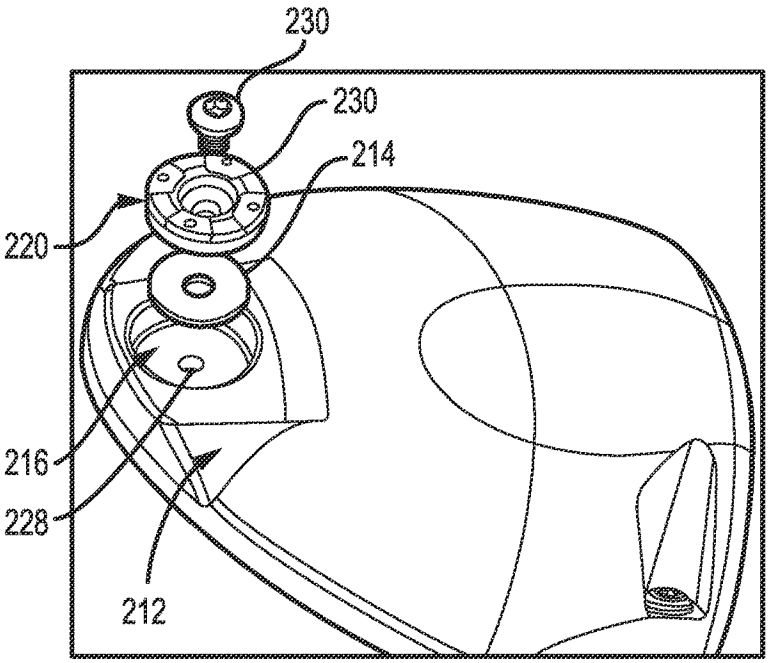
FIG. 11 illustrates an assembly view of a weight, a fastener, and a washer in the golf club head of FIG. 1.
Figure 10:
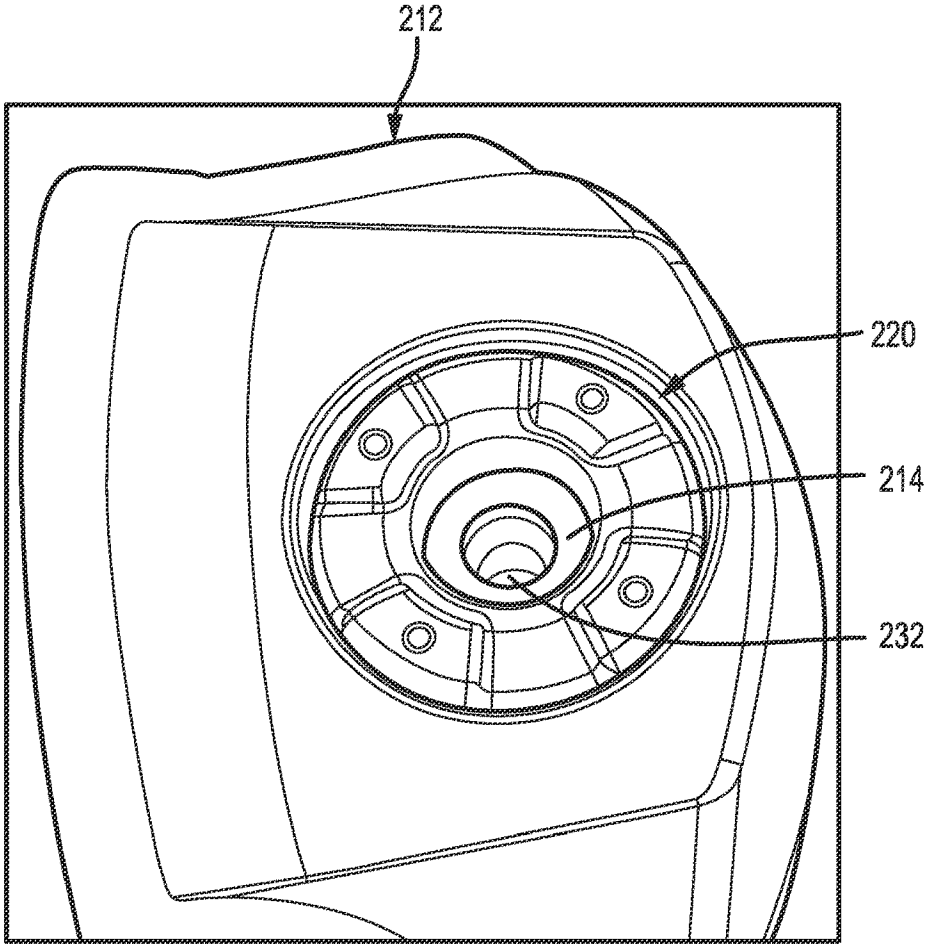
FIG. 10 illustrates an enlarged view of a weight pad and a weight in the golf club head of FIG. 1.

Referring to FIGS. 5, 6, and 9, the front body 104 of the golf club head 100 comprises a strike face 120, positioned to strike a golf ball. The strike face 120 comprises a centerpoint 160, a loft plane 164, and a midplane 168. The center point 160 is equidistant from the crown 112 and sole 116 of the club head 100, and equidistant from the edge of the face that is the most proximate to the toe region 128 and from the edge of the strike face 120 that is the most proximate to the heel region 124. The loft plane 164 is tangent to the centerpoint 160 of the strike face 120 of the club head 100. The loft plane 164 intersects a ground plane 180.

The strike face 120 of the club head 100 comprises a thickness measured as the distance between the strike face 120 and the internal surface 170 of the front body 104. The thickness of the strike face 120 varies at different locations defining a variable face thickness (VFT) or variable thickness profile 196. The variable thickness profile 196 having a central region 192 and a peripheral region 188. In many embodiments, the central region 192 of the variable thickness profile 196 comprises an ellipse or oval or ovoid or egg-like shape. The central region 192 is generally oblong and extends from a portion of the strike face 120 near the sole 116 and heel region 124 to a portion of the strike face 120 near the toe region 128 and crown 112.

Referring to FIG. 6, the central region 192 extends over or is positioned on or near the centerpoint 160 of the strike face 120 such that the center point 160 of the strike face 120 is located in the central region 192. The central region 192 comprises a maximum thickness of the strike face 120. In many embodiments, the thickness of the central region 192 is substantially constant. The peripheral region 188 is positioned around the perimeter 140 of the strike face 120 and comprises a minimum thickness of the strike face 120. In many embodiments, the thickness of the peripheral region 188 is substantially constant. The thickness of the strike face 120 in the central region 192 is greater than the thickness of the strike face 120 in the peripheral region 188. A transition region 190 is positioned between the central region 192 and the peripheral region 188. The transient region 190 includes a varying thickness that creates a transition between the central region 192 and the peripheral region 188.

Furthermore, the strike face 120 comprises a major axis 184 extending in a general heel 124 to toe 128 direction. The major axis 184 intersects the centerpoint 160 and forms an angle β with the ground plane. In many embodiments, the major axis 184 reflects the oblong shape of the central region 192.

The major axis 184 forms an approximate angle of 20 degrees with the ground plane 180. For example, the angle formed between the major axis 184 of the central region 192 and the ground plane 180 can vary from 0 to 60 degrees. In some embodiments, the angle formed between the major axis 184 of the central region 192 and the ground plane 180 can vary from 2 to 20, 2 to 30, 5 to 40, 10 to 50, or 15 to 60 degrees. In other embodiments, the major axis 184 can create an angle of 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 degrees with ground plane 180. By disposing the center region 192 on an angle it further allows the elongated portion of the egg-shape to extend towards the upper-toe portion of the strike face 120 wherein high CT values exist, thus improving resulting ball speed.

The oval or ovoid or egg-like shape, along with the angle of the central region 192 of the variable thickness profile 196, enables thicker regions of the strike face 120 to be positioned in regions having inherently high CT, and thinner regions of the strike face 120 to be positioned in regions having inherently low CT. Accordingly, regions of the face having inherently high CT are reduced, and regions of the face having inherently low CT are increased, resulting in normalized CT across the strike face 120. In many embodiments, the variable thickness profile 196 results in a range in characteristic time less than 115 micro-seconds (μs), less than 110 μs, less than 105 μs, less than 100 μs, less than 95 μs, less than 90 μs, or less than 85 μs. Further, in many embodiments, the variable thickness profile 40 results in an average characteristic time greater than 230 μs, greater than 235 μs, or greater than 240 μs. For example, in many embodiments, the average CT of the face plate 20 can be between 230 μs and 240 μs, between 235 μs and 240 μs, or between 240 μs and 245 μs.

Further, because the angled VFT is designed to position thickened portions of the strike face 120 in regions where it is required, the strike face 120 can experience a weight reduction compared to a strike face devoid of the variable thickness profile 196 described herein. The extra discretionary weight can be re-introduced in other regions of the club head to manipulate the club head center of gravity position and to increase club head moment of inertia, further improving the performance of the club head. In the illustrated embodiment, the club head 100 having the variable thickness profile 196, as described herein, saves 2.1 grams of weight compared to a similar club head devoid of the variable thickness profile 196.

b. Hosel

Figure 1:
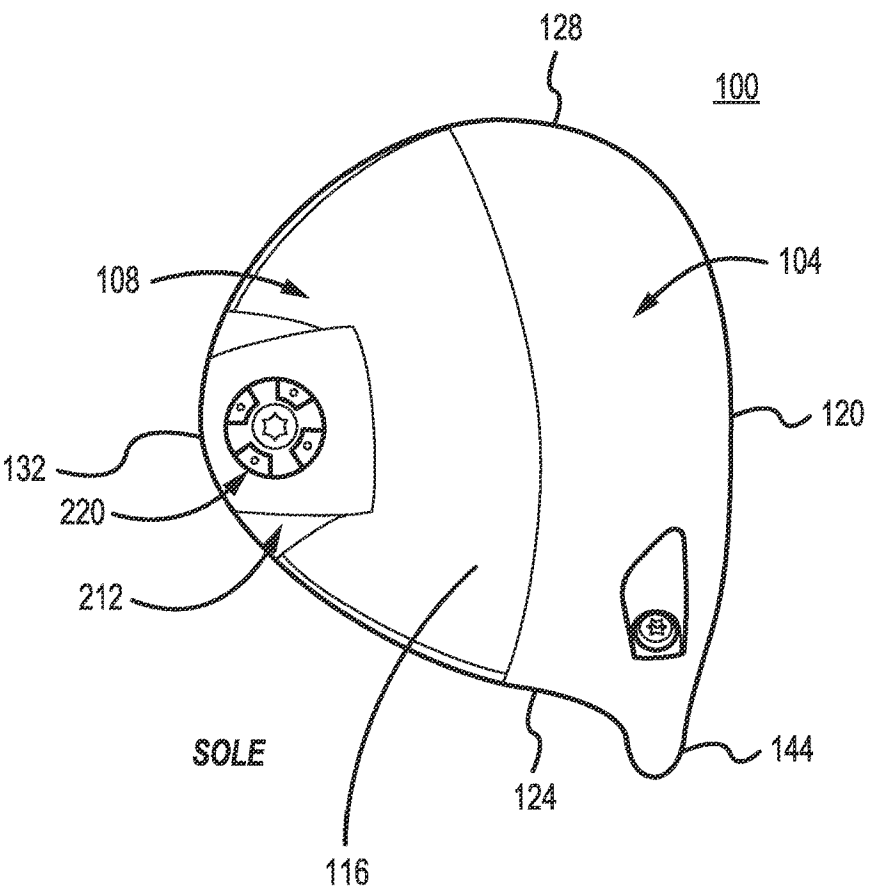
FIG. 1 illustrates a bottom view of a mixed material golf club head.
Figure 3:
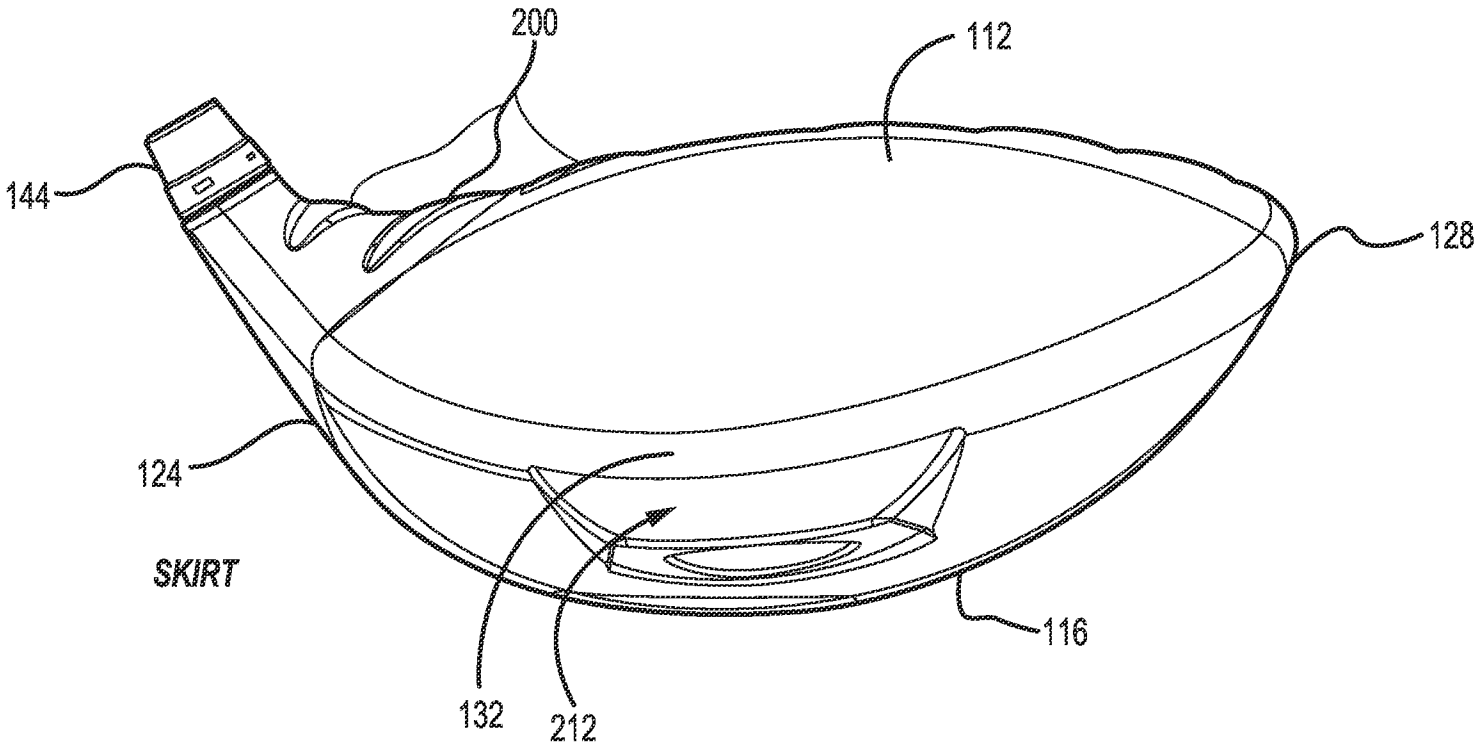
FIG. 3 illustrates a rear view of the golf club head of FIG. 1.

The front body 104 of the golf club head 100 comprises the hosel 144. The hosel 144 includes a hosel axis 176 extending along a center of a bore of the hosel 144. Referring to FIGS. 3 and 6, in the present example, a hosel coupling mechanism of the golf club head 100 comprises the hosel 144 and a shaft sleeve (not shown), where the shaft sleeve can be coupled to an end of a golf shaft (not shown). The shaft sleeve can couple with the hosel 144 in a plurality of configurations, thereby permitting the golf shaft to be secured to the hosel 144 at a plurality of angles relative to the hosel axis 176. There can be other examples, however, where the shaft can be non-adjustably secured to the hosel 144. In the illustrated embodiment, the hosel axis 176 is at an angle α with the ground plane 12 with respect to a front view of the golf club head 10 (FIG. 1). The illustrated angle α is approximately 60-degrees, but in other constructions, the angle α may be between approximately 40-80 degrees (e.g., approximately 40 degrees, approximately 45 degrees, approximately 50 degrees, approximately 55 degrees, approximately 60 degrees, approximately 65 degrees, approximately 70 degrees, approximately 75 degrees, or approximately 80 degrees).

Furthermore, the hosel axis 176 and the major axis 184 form an angle θ. In many embodiments, the angle θ formed between the hosel axis 176 and the major axis 184 can range between 60 and 140 degrees. In most embodiments, the minimum angle θ formed between the hosel axis 176 and the major axis 184 is approximately 60 degrees. In some embodiments, the angle θ formed between the hosel axis 176 and the major axis 184 can range between 60-70 degrees, 70-80 degrees, 80-90 degrees, 90-100 degrees, 100-110 degrees, 110-120 degrees, 120 degrees-130 degrees, or 130-140 degrees. In one embodiment, the angle the angle θ formed between the hosel axis 176 and the major axis 184 can range between 80 degrees and 90 degrees.

c. Surrounding Frame

The front body 104 of the golf club head 100 comprises the surrounding frame 136 that extends rearward from the entire perimeter 140 of the strike face 120. The surrounding frame 136 further comprises a flange 174 that is operative to couple the front body 104 and the rear body 108.

The flange 174 provides a surface, to achieve a lap joint, wherein the rear body 108 can attach. The flange 174 extends rearward from the entire surrounding frame 136, and forms a step-type structure, down from the external surface 172 of the surrounding frame 136. In many embodiments, the flange 174 of the front body 104 allows the rear body to overlap the flange 174 and join to the front body 104, by way of epoxy, adhesion, welding, bonding, laser assisted metal-plastic welding, brazing, or any other suitable attachment method. The lap joint style flange 174, further allows the front body 104 and rear body 108 to securely mate, without the use of any mechanical fasteners.

Furthermore, the surrounding frame 136 comprises the external surface 172 and the internal surface 170, wherein additional aerodynamic features can be placed, to improve the overall speed of the golf club head. The surrounding frame 136 of the front body 104 of the golf club head 100, can include additional aerodynamic features, such as turbulators 200. The turbulators 200 can be used to reduce club head drag and increase the speed of the club 100. These turbulators 200 are further described in U.S. Pat. No. 9,555,294, which is incorporated by reference in its entirety.

II. Rear Body

Referring to FIGS. 4, and 8-13, the rear body 108 of the club head 100 comprises a crown member 204, a sole member 208, and a weight pad 212. The crown member 204 and sole member 208 are bonded together to form a portion of the crown 112 and the sole 116 of the golf club head 100. When the front body 104 and rear body 108 are joined, the external surface 172 of the front body 104, the crown member 204, and the sole member 208, form the entire crown 112 and sole 116 of the golf club head 100. The sole member 208 of the rear body 108 can further comprise a composite resilient layer 152, a composite structural layer 156, and a metallic weight pad 212.

In the present design, the rear body 108 may include a mix of molded thermoplastic materials (e.g., injection molded thermoplastic materials) and fiber reinforced thermoplastic composite materials. As used herein, a molded thermoplastic material is one that relies on the polymer itself to provide structure and rigidity to the final component. The molded thermoplastic material is one that is readily adapted to molding techniques such as injection molding, whereby the material is freely flowable when in a heated to a temperature above the melting point of the polymer. A molded thermoplastic material with a mixed-in filler material is referred to as a filled thermoplastic (FT) material. Filled thermoplastic materials are freely flowable when in a heated/melted state. To facilitate the flowable characteristic, filler materials generally include discrete particulate having a maximum dimension of less than about 25 mm, or more commonly less than about 12 mm. For example, the filler materials can include discrete particulate having a maximum dimension of 4 mm, 5 mm, 6 mm, 7 mm, 8 mm, 9 mm, or 10 mm. Filler materials useful for the present designs may include, for example, glass beads or discontinuous reinforcing fibers formed from carbon, glass, or an aramid polymer.

In contrast to molded and filled thermoplastic materials, fiber reinforced composite (FRC) materials generally include one or more layers of a uni- or multi-directional fiber fabric that extend across a larger portion of the polymer. Unlike the reinforcing fibers that may be used in FT materials, the maximum dimension of fibers used in FRCs may be substantially larger/longer than those used in FT materials and may have sufficient size and characteristics such that they may be provided as a continuous fabric separate from the polymer. When formed with a thermoplastic polymer, even if the polymer is freely flowable when melted, the included continuous fibers are generally not.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. FRC materials traditionally use two-part thermoset epoxies as the polymeric matrix, however, it is possible to also use thermoplastic polymers as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into final shape. This technique enables complex and lightweight geometries to be made, such as the rear body 108, without sacrificing strength.

a. Crown Member

Figure 4:
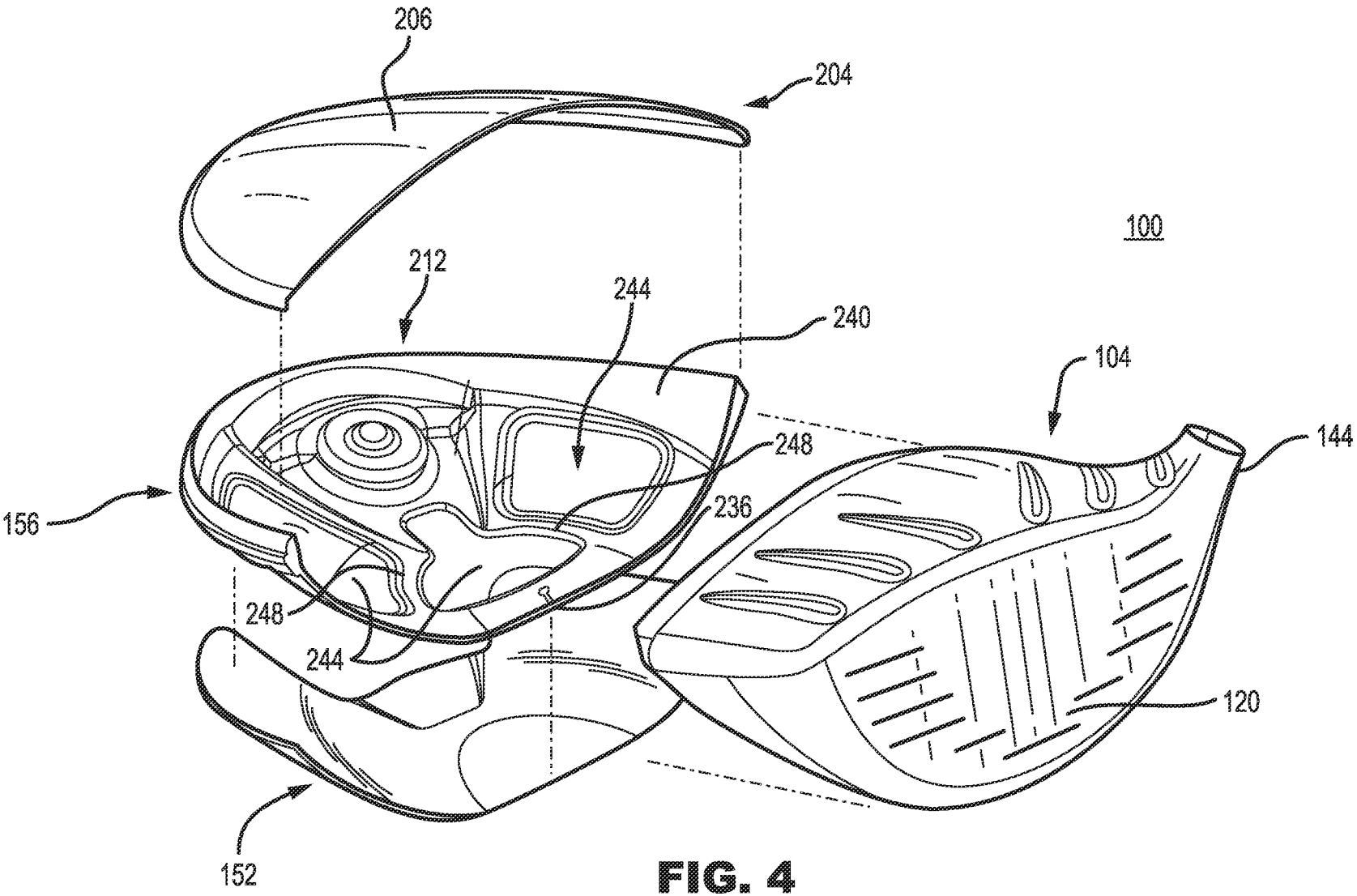
FIG. 4 illustrates an exploded view of the golf club head of FIG. 1.

The rear body 108, comprises the crown member 204. Referring to FIGS. 4 and 9 the crown member 204 comprises an external surface 206, such that when the rear body 108 and front body 104 are joined, the external surface 206 of the crown member 204 and the external surface 172 of the surrounding frame 136 form the entire crown 112 of the golf club head 100. The external surface 206 of the crown member 204 comprises a generally curvilinear shape which is concave with respect to the ground plane 180. The generally curvilinear shape of the crown member 204 allows the rear body 208 to seamlessly be joined to the front body 104, as the crown member is placed entirely over the flange 174 of the front body 104.

In many embodiments, the crown member 204 is comprised of a carbon fiber weave, devoid of any layering of composite plies or unidirectional composite plies. In one embodiment, the crown member 204 may be substantially formed from a formed fiber reinforced composite material that comprises a woven glass or carbon fiber reinforcing layer embedded in a polymeric matrix. In such an embodiment, the polymeric matrix is preferably a thermoplastic material such as, for example, polyphenylene sulfide (PPS), polyether ether ketone (PEEK), or a polyamide such as PA6 or PA66. In other embodiments, the crown member 204 may instead be formed from a filled thermoplastic material that comprises a glass bead or discontinuous glass, carbon, or aramid polymer fiber filler embedded throughout a thermoplastic material such as, for example, polyphenylene sulfide (PPS), polyether ether ketone (PEEK), or polyamide. In still other embodiments, the crown member 204 may have a mixed-material construction that includes both a filled thermoplastic material and a formed fiber reinforced composite material.

b. Sole Member

The rear body 108, comprises the sole member 208. Referring to FIGS. 4 and 9, the sole member 208 comprises the structural layer 156 and the resilient layer 152, providing a lightweight, but strong sole 116 of the golf club head 100. In reference to the ground plane 180, the resilient layer 152 is positioned tangent to the ground plane, and the structural layer 156 is placed on top of the resilient layer 152, in the interior of the golf club head 100.

In one embodiment, the sole member 208 has a mixed-material construction that includes both a fiber reinforced thermoplastic composite resilient layer 152 and a molded thermoplastic structural layer 156. In a preferred embodiment, the molded thermoplastic structural layer 156 may be formed from a filled thermoplastic material that comprises a glass bead or discontinuous glass, carbon, or aramid polymer fiber filler embedded throughout a thermoplastic material such as, for example, polyphenylene sulfide (PPS), polyether ether ketone (PEEK), or a polyamide such as PA6 or PA66. The resilient layer 152 may then comprise a woven glass, carbon fiber, or aramid polymer fiber reinforcing layer embedded in a thermoplastic polymeric matrix that includes, for example, a polyphenylene sulfide (PPS), a polyether ether ketone (PEEK), or a polyamide such as PA6 or PA66. In one particular embodiment, the crown member 202 and resilient layer 152 may each comprise a woven carbon fiber fabric embedded in a polyphenylene sulfide (PPS), and the structural layer 156 may comprise a filled polyphenylene sulfide (PPS) polymer.

The structural layer 156 may generally include a forward portion 236 and a peripheral portion 240 that define an outer perimeter of the sole member 208. In an assembled club head 100, the forward portion 236 is bonded to the metallic front body 104, and the peripheral portion 240 is bonded to the crown member 204. The structural layer 156 defines a plurality of apertures 244 located interior to the perimeter that each extend through the thickness of the structural layer 156. Further, the structural layer 156 may include one or more structural members 248 that extend from the forward portion 236 and between at least two of the plurality of apertures 244. Furthermore, as described below, the structural layer 156 can be configured to comprise a metallic weight pad 212 and metallic weight 220.

The resilient layer 152 may be bonded to the structural layer 156 such that it directly abuts or overlaps at least a portion of the forward portion 236, the peripheral portion 240, and the plurality of structural members 248. In doing so, the resilient layer 152 may entirely cover each of the plurality of apertures 244 when viewed from the exterior of the club head 100. Likewise, the one or more structural members 248 may serve as selective reinforcement to an interior portion of the resilient layer 244, akin to a reinforcing rib or gusset.

With respect to both the polymeric construction of the crown member 204 and the sole member 208, any filled thermoplastics or fiber reinforced thermoplastic composites should preferably incorporate one or more engineering polymers that have sufficiently high material strengths and/or strength/weight ratio properties to withstand typical use while providing a weight savings benefit to the design. Specifically, it is important for the materials of the golf club head 100 to efficiently withstand the stresses imparted during an impact between the strike face 120 and a golf ball, while not contributing substantially to the total weight of the golf club head 100. In general, preferred polymers may be characterized by a tensile strength at yield of greater than about 60 MPa (neat), and, when filled, may have a tensile strength at yield of greater than about 110 MPa, or more preferably greater than about 180 MPa, and even more preferably greater than about 220 MPa. In some embodiments, suitable filled thermoplastic polymers may have a tensile strength at yield of from about 60 MPa to about 350 MPa. In some embodiments, these polymers may have a density in the range of from about 1.15 to about 2.02 in either a filled or unfilled state and may preferably have a melting temperature of greater than about 210° C. or more preferably greater than about 250° C.

c. Weight Pad

With reference to FIGS. 4 and 9-11, in many embodiments, the structural layer 156 can include a weight pad 212. The weight pad 212 comprises a cavity 216 adapted to receive a metallic weight 220. In some embodiments, the weight pad 212 is generally located toward the rear most point on the club head 100, and therefore may be integral to and/or directly coupled with the rear portion 132 of the structural layer 156. In some embodiments, a hole or opening 252 may be provided in the resilient layer 152, through which a portion of the weight pad 212 may extend. In some embodiments, the opening 250 is spaced apart from the front body 104 by a minimum distance of at least 25 mm, or at least 30 mm, or at least 35 mm (i.e., measured along the outer surface of the club head). As shown in FIG. 9, when assembled, an outer surface of the weight pad 212 may sit flush with an outer surface of the directly adjacent sole member 208 and/or resilient layer 152. In this manner, a portion of the weight pad 212 may form part of the external sole 116 of the golf club head 100. Additionally, in some embodiments, an internal surface of the weight pad 212 may be exposed on an interior of the clubhead. The weight pad 212 functions to provide a dense rearward mass to improve the overall MOI of the golf club head. The weight pad 212 and weight 220 provide a region to place a high concentration of discretionary mass, since there are substantially weight savings achieved from forming the composite rear body 108.

The weight pad 212 can comprise any desired shape, in order to position as much mass towards the periphery of the rear portion 132 of the golf club head 100. The shape of the weight pad 212 can be any one of the following shapes: circular, triangular, square, rectangular, trapezoidal, pentagonal, curvilinear, spade-shaped, or any other polygon or shape with at least one curved surface. In one embodiment, the weight pad 212 can be a roughly trapezoidal shape. In another embodiment, the weight pad 212 can be a roughly rectangular shape. Furthermore, in another embodiment, the weight pad 212 can be a roughly circular shape. Further still, in another embodiment, the weight pad 212 can be a roughly triangular shape.

In most embodiments, the weight pad 212 can be made from a metallic material to provide a dense rearward portion to improve the overall MOI of the golf club head 100. In some embodiments, the weight pad 212 can be formed from stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In one embodiment, the weight pad 212 can be made from a stainless steel. The weight pad 212 can be forged or cast, prior to being secured within the sole member 208 of the rear body 108.

Figure 13:
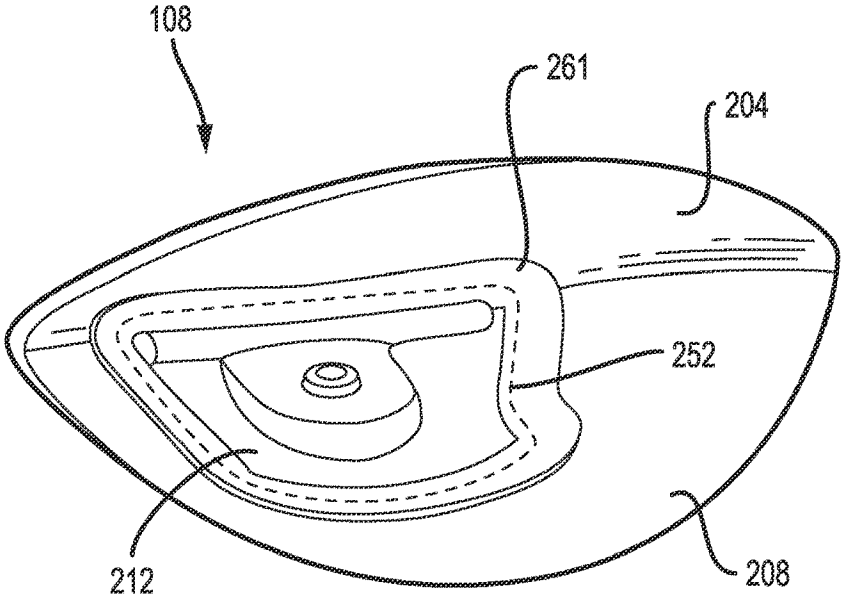
FIG. 13 illustrates an alternate internal view of the rear body of the golf club head of FIG. 1.
Figure 12:
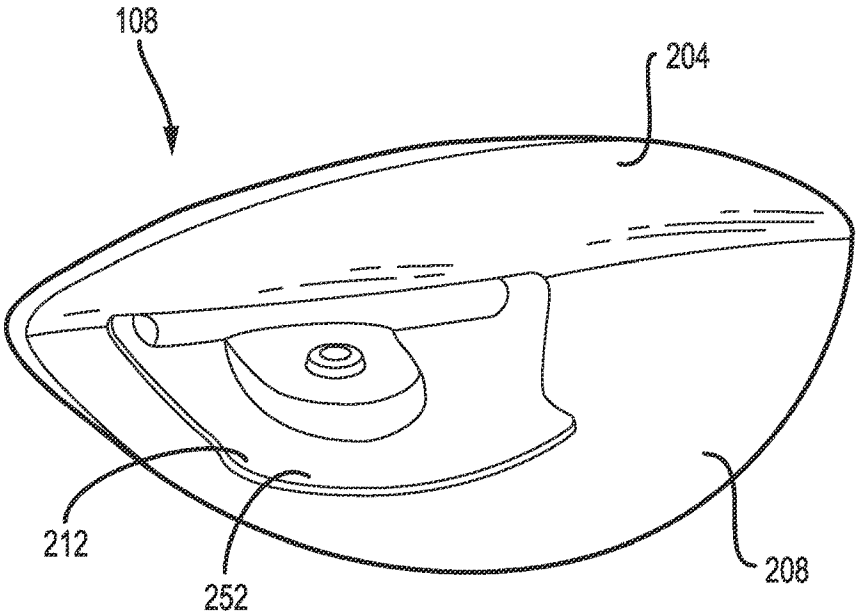
FIG. 12 illustrates an internal view of the rear body of the golf club head of FIG. 1.

The weight pad 212 may be secured within the opening 250 in resilient layer 152 through via one or more techniques that are operable to provide a robust, structural bond. Due to differences in material types/material surface energies, as well as the comparatively high ratio of component mass to contact surface area, it may be difficult for conventional adhesives alone to withstand the forces experienced during a golf club impact with a ball. As such, it may be desirable to integrate at least a portion of the weight pad into the structural layer 156 and/or resilient layer 152 by encapsulating at least a portion of the weight pad. In doing so, the material strength of the encapsulating layer may be operative to provide a more durable bond than the use of surface adhesives alone. Referring to FIGS. 9 and 13, examples of suitable encapsulation may include structural tapes 261 extending over an edge 252 of the weight pad 212, direct encapsulation of at least a portion of the weight pad 212 by the structural layer 156, or encapsulation of a portion of the weight pad between adjacent plies of the resilient layer 152. These techniques may be used instead of, or in addition to the use of chemical adhesives provided between the weight pad and sole member 208.

In one configuration, the weight pad 212 may be attached to the sole member 208 without the use of any mechanical fasteners. In one embodiment, the weight pad 212 is casted and then the structural layer 156 may be molded around at least the edge 252 of the weight pad 212, for example, via an insert injection molding or comolding technique. As noted above, the filled thermoplastic construction of the structural layer 156 is particularly suited to receive the weight pad 212 due to its ability to form complex geometry and extend around edges in a structurally stable manner. Depending on the geometry of the weight pad, such a joining technique may be more difficult with tapes or FRCs due to their more uniform profile.

The cavity 216 of the weight pad 212 extends inward from weight pad 212. In the illustrated embodiment, the cavity 216 comprises a circular shape. In other embodiments, the cavity 216 can comprise any shape. For example, the shape of the cavity 216 can comprise a circle, an ellipse, a triangle, a rectangle, an octagon, or any other polygon or shape with at least one curved surface. The cavity 216 provides a recess to affix a metallic weight 220 within. The metallic weight 220, further adds discretionary weight to the golf club head 100, thus further improving the MOI and CG of the golf club head 100. Additionally, the cavity 216 and metallic weight 220 allow for changes to be made to the overall weight of the golf club head 100, by removably attaching different metallic weights of different densities.

The cavity 212 includes a depth measured from a base 224 of the cavity 212 to the external contour of the sole member 208, in a direction generally perpendicular to the base 224. In many embodiments, the depth of the cavity 212 is between 0.10 inches and 0.50 inches. In some embodiments, the depth of the cavity 212 is less than 0.50 inches, less than 0.45 inches, less than 0.40 inches, less than 0.35 inches, less than 0.30 inches, less than 0.25 inches, less than 0.20 inches, or less than 0.15 inches.

Further, the cavity 212 comprises an aperture 228 in the base 224. The aperture 228 extends inward from the base 224 of the cavity 212, towards the crown 112 of the golf club head 100. In some embodiments, the aperture 228 can comprise threading that mates with the threading of a fastener 230 to secure the metallic weight 220 within the cavity 216. In other embodiments, the aperture 228 can be devoid of threading for use with a self-tapping or self-drilling fastener.

The metallic weight 220 is configured to be positioned with the cavity 216 of the weight pad 212. In the illustrated embodiment, the weight 220 is circular in shape to correspond to the shape of the cavity 212. In other embodiments, the weight 220 can comprise any geometric shape corresponding to the shape of the cavity 212 (e.g., circular, elliptical, triangular, rectangular, trapezoidal, octagonal, or any other polygonal shape or shape with at least one curved surface).

The metallic weight 220 further comprises an aperture 232 extending entirely through the weight 220. The aperture 232 is substantially similar in size to the aperture 228 of the cavity 212 and the aperture 232 of the weight 220 aligns with the aperture 228 of the cavity 212, when the weight is positioned within the cavity 212. In most embodiments, the aperture 232 is devoid of threading to allow the fastener 230 to pass through the weight 220 and secure, via threading, to the aperture 228 of the weight pad 212. Additionally, in some embodiments, a washer 214 can be positioned in the cavity 212 prior to the positioning of the metallic weight 220 within the cavity 212.

d. Assembly

Figure 14:
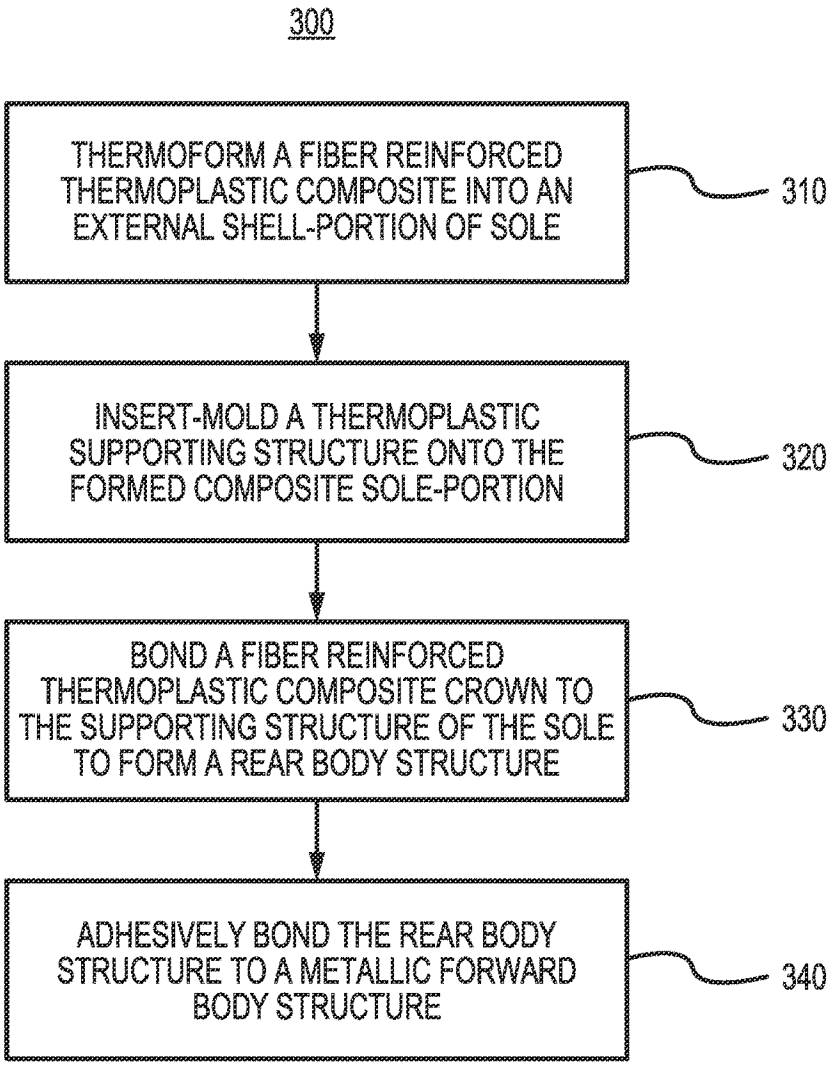
FIG. 14 illustrates is a schematic flow chart illustrating a method of manufacturing of the golf club head of FIG. 1.

FIG. 14 illustrates an embodiment of a method 300 for manufacturing a golf club head 100 having the integrally bonded resilient layer 152, structural layer 156, and metallic weight pad 220 of the sole member 208. The method 300 involves thermoforming a fiber reinforced thermoplastic composite into an external shell portion of the club head 100 at step 310. The thermoforming process may involve, for example, pre-heating a thermoplastic prepreg to a molding temperature at least above the glass transition temperature of the thermoplastic polymer, molding the prepreg into the shape of the shell portion, and then trimming the molded part to size.

Once the composite shell portion is in a proper shape, a filled polymeric supporting structure may then be injection molded into direct contact with the shell at step 320. Such a process is generally referred to as insert-molding. In this process, the shell is directly placed within a heated mold having a gated cavity exposed to a portion of the shell. Molten polymer is forcibly injected into the cavity, and thereafter either directly mixes with molten polymer of the heated composite shell, or locally bonds with the softened shell. As the mold is cooled, the polymer of the composite shell and supporting structure harden together in a fused relationship. The bonding is enhanced if the polymer of the shell portion and the polymer of the supporting structure are compatible and is even further enhanced if the two components include a common thermoplastic resin component. While insert-molding is a preferred technique for forming the structure, other molding techniques, such as compression molding, may also be used.

With continued reference to FIG. 14, once the sole member 208 is formed through steps 310 and 320, an FRC crown member 204 may be bonded to the sole member 208 to substantially complete the structure of the rear body 108 (step 330). In a preferred embodiment, the crown member 204 may be formed from a thermoplastic FRC material that is formed into shape using a similar thermoforming technique as described with respect to step 310. Forming the crown member 204 from a thermoplastic composite allows the crown member 204 to be bonded to the sole member 208 using a localized welding technique. Such welding techniques may include, for example, laser welding, ultrasonic welding, or potentially electrical resistance welding if the polymers are electrically conductive. If the crown member 204 is instead formed using a thermoset polymer, then the crown member 204 may be bonded to the sole member 208 using, for example, an adhesive or a mechanical affixment technique (studs, screws, posts, mechanical interference engagement, etc).

The rear body 108, comprising the affixed crown member 204 and sole member 208 may subsequently be adhesively bonded to the metallic front body 104 at step 340. While adhesives readily bond to most metals, the process of adhering to the polymer may require the use of one or more adhesion promoters or surface treatments to enhance bonding between the adhesive and the polymer of the rear body 108.

III. Benefits

Utilizing a mixed material rear body construction can provide a significant reduction in structural weight while not sacrificing any design flexibility and providing a robust means for reintroducing discretionary mass. While such a design may be formed entirely from a filled thermoplastic, such as polyphenylene sulfide (PPS), as discussed above, the use of a fiber reinforced composite provides a stronger and lighter construction across continuous outer surfaces. Conversely, an all-FRC design would not readily incorporate weight-receiving structures, and thus would not be able to easily capitalize on increased discretionary mass.

The metallic weight pad is beneficial over a mixed material golf club head devoid a metallic weight pad because the metallic weight pad allows for variance and interchangeability of the metallic weight, while providing a durable and secure location to affix the metallic weight. In comparison to a golf club head devoid of the metallic weight pad, the metallic weight pad securely withstands the torque imparted on the weight pad when a weight is being affixed. Further, the metallic weight pad allows for the manufacturer to interchange the metallic weight, to adjust for manufacturing tolerances (i.e., change the desired swing weight of the overall club head from 206 grams to 209 grams), or adjust for customer specification (i.e., a golfer wants his/her club head heavier, 206 grams to 209 grams).

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

The above examples may be described in connection with a wood-type golf club, the apparatus, methods, and articles of manufacture described herein. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following clauses:

Clause 1: A golf club head comprising: a metallic front body including a strike face and a surrounding frame that extends rearward from a perimeter of the strike face; wherein the strike face has a centerpoint, a loft plane tangent to the centerpoint along the strike face, and a midplane extending through the centerpoint from the heel to the toe and perpendicular to the loft plane; a rear body coupled to the metallic front body, wherein the rear body and front body form a substantially hollow structure with a cavity therebetween; the rear body comprises a crown member and a sole member, wherein the sole member is coupled to the crown member, wherein the sole member comprises: a structural layer formed from a filled thermoplastic material, the structural layer including a plurality of apertures extending through a thickness of the structural layer; and a resilient layer bonded to an external surface of the structural layer such that the resilient layer extends across each of the plurality of apertures, wherein the resilient layer is formed from a fiber-reinforced thermoplastic composite material and defines an opening; a metallic weight pad extending at least partially through the opening in the resilient layer and bonded to the structural layer, wherein the metallic weight pad comprises an aperture for the attachment of a metallic weight; and wherein the structural layer and the resilient layer each comprise a common thermoplastic resin component, and wherein the structural layer is directly bonded to the resilient layer without an intermediate adhesive.

Clause 2: The golf club head of clause 1, wherein the metallic front body further includes a flange that is inwardly recessed from an external surface of the surrounding frame;

wherein the structural layer of the sole member is adhesively bonded to the flange; and wherein the external surface of the resilient layer of the sole member is flush with the external surface of the surrounding frame.

Clause 3: The golf club head of clause 2, wherein the metallic front body further includes an extension wall that couples the surrounding frame to the flange; wherein the structural layer of the sole member includes a structural member extending towards the metallic front body from the weighted pad; wherein the structural member is operative to transfer a dynamic load between the weight pad and the extension wall during an impact between the strike face and a golf ball.

Clause 4: The golf club head of any of clauses 1-3, comprises a head center of gravity located at a head CG depth from the loft plane, measured in a direction perpendicular to the loft plane, and at a head CG height from the midplane, measured in a direction perpendicular to the midplane; wherein the head CG depth is greater than 1.7 inches.

Clause 5: The golf club head of any of clauses 1-4, wherein the metallic front body further comprises a strike face insert and a receiving frame; wherein the receiving frame has a greater density than the strike face insert.

Clause 6: The golf club head of any of clauses 1-5, wherein the mass of the front body does not exceed 140 g and the total mass of the golf club head does not exceed 210 g.

Clause 7: The golf club head of any of clauses 1-6, wherein a mechanical fastener affixes the metallic weight within the aperture of the metallic weight pad; wherein the aperture of the metallic weight pad of the structural layer comprises threading, and the metallic weight is devoid of threading.

Clause 8: The golf club head of any of clauses 1-7, wherein the metallic weight has a mass ranging from 5 grams to 30 grams.

Clause 9: A golf club head comprising: a metallic front body including a strike face and a surrounding frame that extends rearward from a perimeter of the strike face; wherein the strike face has a centerpoint, a loft plane tangent to the centerpoint along the strike face, and a midplane extending through the centerpoint from the heel to the toe and perpendicular to the loft plane; a rear body coupled to the metallic front body, wherein the rear body and front body form a substantially hollow structure with a cavity therebetween, the rear body comprises a crown member and a sole member, wherein the sole member coupled to the crown member, wherein the sole member comprises: a structural layer formed from a filled thermoplastic material and bonded to the crown member, the structural layer including a plurality of apertures extending through a thickness of the structural layer; and a resilient layer bonded to an external surface of the structural layer without an intermediate adhesive such that the resilient layer abuts the metallic front body and extends across each of the plurality of apertures; wherein the structural layer is formed from a first material consisting of a first plurality of fibers disposed within a first thermoplastic polymer, and the resilient layer is formed from a second material consisting of a second plurality of fibers disposed within a second thermoplastic polymer, wherein an amount of the first thermoplastic polymer, by volume, within the first material is greater than an amount of the second thermoplastic polymer, by volume, within the second material; wherein the structural layer and the resilient layer each comprise a common thermoplastic resin component, and wherein the structural layer is directly bonded to the resilient layer without an intermediate adhesive; and wherein the structural layer of the sole member includes a metallic weight pad, wherein the metallic weight pad comprises an aperture for the attachment of a metallic weight.

Clause 10: The golf club head of clause 9, wherein the metallic front body further includes a flange that is inwardly recessed from an external surface of the surrounding frame; wherein the structural layer of the sole member is adhesively bonded to the flange; and wherein the external surface of the resilient layer of the sole member is flush with the external surface of the surrounding frame.

Clause 11: The golf club head of any of clauses 9-10, wherein the metallic front body further includes an extension wall that couples the surrounding frame to the bonding flange; wherein the structural layer of the sole member includes a structural member extending towards the metallic front body from the weighted pad; wherein the structural member is operative to transfer a dynamic load between the weight pad and the extension wall during an impact between the strike face and a golf ball.

Clause 12: The golf club head of any of clauses 9-11, wherein the first thermoplastic polymer is directly bonded to the second thermoplastic polymer.

Clause 13: The golf club head of any of clauses 9-12, wherein the first plurality of fibers comprises a plurality of discontinuous fibers, each having a maximum dimension of less than 0.43 inches.

Clause 14: The golf club head of any of clauses 9-13, wherein the second plurality of fibers comprises a plurality of continuous fibers interwoven as a fabric.

Clause 15: The golf club head of any of clauses 9-14, wherein the first thermoplastic polymer is the same as the second thermoplastic polymer.

Clause 16: The golf club head of any of clauses 9-15, wherein the mass of the front body does not exceed 140 g and the total mass of the golf club head does not exceed 210 g.

Clause 17: The golf club head of any of clauses 9-16, comprises a head center of gravity located at a head CG depth from the loft plane, measured in a direction perpendicular to the loft plane, and at a head CG height from the midplane, measured in a direction perpendicular to the midplane; wherein the head CG depth is greater than 1.7 inches.

Clause 18: The golf club head of any of clauses 9-17, wherein the metallic front body further comprises a strike face insert and a receiving frame; wherein the receiving frame has a greater density than the strike face insert.

Clause 19: The golf club head of any of clauses 9-18, wherein a mechanical fastener affixes the metallic weight within the aperture of the metallic weight pad; wherein the aperture of the metallic weight pad of the structural layer comprises threading, and the metallic weight is devoid of threading.

Clause 20: The golf club head of any of clauses 9-19, wherein the metallic weight has a mass ranging from 5 grams to 30 grams.

The invention claimed is:

1. A golf club head comprising:

a heel and a toe opposite the heel;

a metallic front body including a strike face and a surrounding frame that extends rearward from a perimeter of the strike face; wherein the strike face has a centerpoint, a loft plane tangent to the centerpoint along the strike face, and a midplane extending through the centerpoint from the heel to the toe and perpendicular to the loft plane;

a rear body coupled to the metallic front body, wherein the rear body and the metallic front body form a substantially hollow structure with a cavity therebetween, wherein the rear body comprises a crown member and a sole member, wherein the sole member is coupled to the crown member, and wherein the sole member comprises:

a structural layer formed from a filled thermoplastic material, comprising a thermoplastic resin component and a plurality of reinforcing fibers; and a metallic weight pad bonded to the structural layer, wherein the metallic weight pad comprises an aperture for the attachment of a metallic weight; and a head center of gravity located at a head CG depth from the loft plane, measured in a direction perpendicular to the loft plane, and at a head CG height from the midplane, measured in a direction perpendicular to the midplane; wherein the head CG depth is greater than 1.7 inches; and the crown member comprises a crown filled thermoplastic layer and a crown resilient layer;

the crown filled thermoplastic layer is formed from a first material consisting of a first plurality of fibers disposed within a first thermoplastic polymer, the crown resilient layer is formed from a second material consisting of a second plurality of fibers disposed within a second thermoplastic polymer; and an amount of the first thermoplastic polymer, by volume, within the crown filled thermoplastic layer is greater than an amount of the second thermoplastic polymer, by volume, within the crown resilient layer.

2. The golf club head of claim 1, wherein the crown member comprises a crown structural layer formed from a filled thermoplastic material.

3. The golf club head of claim 2, wherein the filled thermoplastic material of the crown structural layer is the same as the filled thermoplastic material of the structural layer of the sole member.

4. The golf club head of claim 1, wherein the crown member comprises a plurality of continuous fibers interwoven as a fabric and embedded in a thermoplastic resin.

5. The golf club head of claim 1, wherein the first thermoplastic polymer and the second thermoplastic polymer share a common thermoplastic resin.

6. The golf club head of claim 1, wherein:

the first plurality of fibers comprises a plurality of discontinuous fibers, each having a maximum dimension of less than 0.43 inch; and the second plurality of fibers comprises a plurality of continuous fibers interwoven as a fabric.

7. The golf club head of claim 1, wherein the crown member comprises a generally curvilinear shape which is concave with respect to a ground plane.

8. The golf club head of claim 1, wherein:

the metallic front body further includes a flange that is inwardly recessed from an external surface of the surrounding frame;

the structural layer of the sole member is adhesively bonded to the flange; and an external surface of the sole member is flush with the external surface of the surrounding frame.

9. The golf club head of claim 8, wherein:

the metallic front body further includes an extension wall that couples the surrounding frame to the flange;

the structural layer of the sole member includes a structural member extending towards the metallic front body from the weighted pad; and the structural member is operative to transfer a dynamic load between the weight pad and the extension wall during an impact between the strike face and a golf ball.

10. The golf club head of claim 1, wherein:

the metallic front body further comprises a strike face insert and a receiving frame; and the receiving frame has a greater density than the strike face insert.

11. The golf club head of claim 1, wherein the mass of the front body does not exceed 140 g and the total mass of the golf club head does not exceed 210 g.

12. The golf club head of claim 1, wherein:

a mechanical fastener affixes the metallic weight within the aperture of the metallic weight pad;

the aperture of the metallic weight pad of the structural layer comprises threading; and the metallic weight is devoid of threading.

13. The golf club head of claim 1, wherein the metallic weight has a mass ranging from 5 grams to 30 grams.

14. The golf club head of claim 1, wherein a portion of the metallic weight pad is encapsulated within the structural layer of the sole member, to increase the strength of the bond between the metallic weight pad and the structural layer.

15. The golf club head of claim 1, wherein:

the golf club head further comprises an encapsulating layer between the metallic weight pad and the structural layer of the sole member; and the encapsulating layer is a structural tape that extends over an edge of the metallic weight pad and forms a strong adhesive bond between the metallic weight pad and the structural layer of the sole member.

16. The golf club head of claim 1, wherein:

the golf club head further comprises a rear portion; and the metallic weight pad is directly coupled to the structural layer at a periphery of the rear portion.

17. The golf club head of claim 1, wherein:

the metallic weight pad extends through an opening in the structural layer of the sole member; and the opening is spaced apart from the metallic front body by a minimum distance of at least 25 mm.

18. The golf club head of claim 17, wherein an internal surface of the metallic weight pad is exposed on an interior of the golf club head.

19. The golf club head of claim 1, wherein the metallic weight pad comprises a material selected from the group consisting of: stainless steel, titanium, aluminum, and a steel alloy.

20. A golf club head comprising:

a heel and a toe opposite the heel;

a metallic front body including a strike face and a surrounding frame that extends rearward from a perimeter of the strike face; wherein the strike face has a centerpoint, a loft plane tangent to the centerpoint along the strike face, and a midplane extending through the centerpoint from the heel to the toe and perpendicular to the loft plane;

a rear body coupled to the metallic front body, wherein the rear body and the metallic front body form a substantially hollow structure with a cavity therebetween, wherein the rear body comprises a crown member and a sole member, wherein the sole member is coupled to the crown member, and wherein the sole member comprises:

a structural layer formed from a filled thermoplastic material, comprising a thermoplastic resin component and a plurality of reinforcing fibers; and a metallic weight pad bonded to the structural layer, wherein the metallic weight pad comprises an aperture for the attachment of a metallic weight; and a head center of gravity located at a head CG depth from the loft plane, measured in a direction perpendicular to the loft plane, and at a head CG height from the midplane, measured in a direction perpendicular to the midplane; wherein the head CG depth is greater than 1.7 inches; and a mechanical fastener affixes the metallic weight within the aperture of the metallic weight pad;

the aperture of the metallic weight pad of the structural layer comprises threading; and the metallic weight is devoid of threading.

21. The golf club head of claim 20, wherein the crown member comprises a crown structural layer formed from a filled thermoplastic material.

22. The golf club head of claim 21, wherein the filled thermoplastic material of the crown structural layer is the same as the filled thermoplastic material of the structural layer of the sole member.

23. The golf club head of claim 20, wherein the crown member comprises a plurality of continuous fibers interwoven as a fabric and embedded in a thermoplastic resin.

24. The golf club head of claim 20, wherein the crown member comprises a crown filled thermoplastic layer and a crown resilient layer;

the crown filled thermoplastic layer is formed from a first material consisting of a first plurality of fibers disposed within a first thermoplastic polymer, the crown resilient layer is formed from a second material consisting of a second plurality of fibers disposed within a second thermoplastic polymer; and an amount of the first thermoplastic polymer, by volume, within the crown filled thermoplastic layer is greater than an amount of the second thermoplastic polymer, by volume, within the crown resilient layer.

25. The golf club head of claim 24, wherein the first thermoplastic polymer and the second thermoplastic polymer share a common thermoplastic resin.

26. The golf club head of claim 24, wherein:

the first plurality of fibers comprises a plurality of discontinuous fibers, each having a maximum dimension of less than 0.43 inch; and the second plurality of fibers comprises a plurality of continuous fibers interwoven as a fabric.

27. The golf club head of claim 20, wherein the crown member comprises a generally curvilinear shape which is concave with respect to a ground plane.

28. The golf club head of claim 20, wherein:

the metallic front body further includes a flange that is inwardly recessed from an external surface of the surrounding frame;

the structural layer of the sole member is adhesively bonded to the flange; and an external surface of the sole member is flush with the external surface of the surrounding frame.

29. The golf club head of claim 28, wherein:

the metallic front body further includes an extension wall that couples the surrounding frame to the flange;

the structural layer of the sole member includes a structural member extending towards the metallic front body from the weighted pad; and the structural member is operative to transfer a dynamic load between the weight pad and the extension wall during an impact between the strike face and a golf ball.

30. The golf club head of claim 20, wherein:

the metallic front body further comprises a strike face insert and a receiving frame; and the receiving frame has a greater density than the strike face insert.

31. The golf club head of claim 20, wherein the mass of the front body does not exceed 140 g and the total mass of the golf club head does not exceed 210 g.

32. The golf club head of claim 20, wherein the metallic weight has a mass ranging from 5 grams to 30 grams.

33. The golf club head of claim 20, wherein a portion of the metallic weight pad is encapsulated within the structural layer of the sole member, to increase the strength of the bond between the metallic weight pad and the structural layer.

34. The golf club head of claim 20, wherein:

the golf club head further comprises an encapsulating layer between the metallic weight pad and the structural layer of the sole member; and the encapsulating layer is a structural tape that extends over an edge of the metallic weight pad and forms a strong adhesive bond between the metallic weight pad and the structural layer of the sole member.

35. The golf club head of claim 20, wherein:

the golf club head further comprises a rear portion; and the metallic weight pad is directly coupled to the structural layer at a periphery of the rear portion.

36. The golf club head of claim 20, wherein:

the metallic weight pad extends through an opening in the structural layer of the sole member; and the opening is spaced apart from the metallic front body by a minimum distance of at least 25 mm.

37. The golf club head of claim 36, wherein an internal surface of the metallic weight pad is exposed on an interior of the golf club head.

38. The golf club head of claim 20, wherein the metallic weight pad comprises a material selected from the group consisting of: stainless steel, titanium, aluminum, and a steel alloy.

* * * * *